US010468837B2

(12) United States Patent
Schroll et al.

(10) Patent No.: US 10,468,837 B2
(45) Date of Patent: Nov. 5, 2019

(54) COAXIAL CONNECTOR ASSEMBLY

(71) Applicant: TYCO ELECTRONICS CORPORATION, Berwyn, PA (US)

(72) Inventors: Neil Franklin Schroll, Mount Joy, PA (US); John Mark Myer, Millersville, PA (US)

(73) Assignee: TE Connectivity Corporation, Berwyn, PA (US)

( * ) Notice: Subject to any disclaimer, the term of this patent is extended or adjusted under 35 U.S.C. 154(b) by 5 days.

(21) Appl. No.: 15/277,000

(22) Filed: Sep. 27, 2016

(65) Prior Publication Data

US 2018/0090891 A1 Mar. 29, 2018

(51) Int. Cl.

| | |
|---|---|
| ***H01R 24/38*** | (2011.01) |
| ***H01R 13/631*** | (2006.01) |
| ***H01R 13/115*** | (2006.01) |
| ***H01R 13/6593*** | (2011.01) |
| ***H01R 24/54*** | (2011.01) |
| *H01R 103/00* | (2006.01) |
| *H01R 4/48* | (2006.01) |

(52) U.S. Cl.

CPC ..... *H01R 24/38* (2013.01); *H01R 13/115* (2013.01); *H01R 13/631* (2013.01); *H01R 13/6593* (2013.01); *H01R 24/545* (2013.01); *H01R 4/4818* (2013.01); *H01R 2103/00* (2013.01)

(58) Field of Classification Search

CPC .... H01R 24/38; H01R 13/115; H01R 13/631; H01R 13/6593; H01R 24/545; H01R 4/4818

USPC ..... 439/582, 856

See application file for complete search history.

(56) References Cited

U.S. PATENT DOCUMENTS

| | | | | |
|---|---|---|---|---|
| 2,813,144 A * | 11/1957 | Valach | H01R 24/545 174/87 |
| 6,106,333 A * | 8/2000 | Purdy | H01R 24/547 439/578 |
| 6,254,440 B1 * | 7/2001 | Ko | H01R 13/112 439/857 |
| 6,283,790 B1 * | 9/2001 | Idehara | H01R 13/504 439/582 |
| 6,287,144 B1 | 9/2001 | Baffert | |

(Continued)

FOREIGN PATENT DOCUMENTS

WO 2015164090 A2 10/2015

OTHER PUBLICATIONS

International Search Report, International Application No. PCT/IB2017/055891, International Filing Date Sep. 27, 2017.

*Primary Examiner* — Felix O Figueroa

(57) ABSTRACT

A coaxial connector assembly includes a housing holding an outer contact and a dielectric holder received in the outer contact. The dielectric holder has a mating segment having a front cavity and a cable segment having a cable cavity receiving a cable assembly. The cable assembly has a pin contact. A center contact is received in the front cavity of the dielectric holder. The center contact has a base positioned in the dielectric holder generally at an intersection of the front cavity and the cable cavity. The center contact has deflectable pin beams extending from the base. The pin beams have flared lead-in tips at distal ends of the beams. The base and the pin beams are axially aligned with the cable axis to receive the pin contact.

22 Claims, 4 Drawing Sheets

(56) References Cited

U.S. PATENT DOCUMENTS

| | | | | |
|---|---|---|---|---|
| 6,464,547 | B2 * | 10/2002 | Ketelsleger | H01R 13/4223 439/748 |
| 6,953,371 | B2 * | 10/2005 | Baker | H01R 9/0515 439/582 |
| 8,047,872 | B2 * | 11/2011 | Burris | H01R 13/502 439/271 |
| 8,251,762 | B2 | 8/2012 | Maier et al. | |
| 8,641,447 | B2 * | 2/2014 | Sykes | H01R 24/44 439/582 |
| 2008/0261445 | A1 | 10/2008 | Malloy et al. | |
| 2010/0317226 | A1 | 12/2010 | Schmid et al. | |
| 2012/0252267 | A1 * | 10/2012 | Nugent | H01R 24/545 439/582 |

* cited by examiner

COAXIAL CONNECTOR ASSEMBLY

BACKGROUND OF THE INVENTION

The subject matter herein relates generally to coaxial connector assemblies.

Radio frequency (RF) coaxial connector assemblies have been used for numerous applications including military applications and automotive applications, such as global positioning systems (GPS), antennas, radios, mobile phones, multimedia devices, and the like. The connector assemblies are typically coaxial cable connectors that are provided at the end of coaxial cables.

In order to standardize various types of connector assemblies, particularly the interfaces for such connector assemblies, certain industry standards have been established. One of these standards is referred to as FAKRA. FAKRA is the Automotive Standards Committee in the German Institute for Standardization, representing international standardization interests in the automotive field. The FAKRA standard provides a system, based on keying and color coding, for proper connector attachment. Like jack keys can only be connected to like plug keyways in FAKRA connectors. Secure positioning and locking of connector housings is facilitated by way of a FAKRA defined catch on the jack housing and a cooperating latch on the plug housing.

The connector assemblies include a center contact and an outer contact that provides shielding for the center contact. The center contact is typically a socket that receives a pin contact. Conventional connector assemblies are typically linear or in-line with the cable extending parallel to the mating axis. However, some applications require one or both of the connector assemblies to be right-angle connectors having the cable 90° to the mating axis. Assembly of such right-angle coaxial connector assemblies is difficult. The right-angle coaxial connector assemblies typically include multiple contacts that are mated within the assembly. Reliable mating of the contacts is difficult due to tolerances and overstress. An unreliable electrical connection may occur in such situation. The contacts are susceptible to stubbing and damage.

A need remains for a coaxial connector assembly that may be manufactured in a cost effective and reliable manner.

BRIEF DESCRIPTION OF THE INVENTION

In one embodiment, a coaxial connector assembly is provided including a housing holding an outer contact and a dielectric holder received in the outer contact. The dielectric holder has a mating segment and a cable segment orthogonal to the mating segment. The mating segment has a front cavity extending along a mating axis and the cable segment has a cable cavity extending along a cable axis. A cable assembly is received in the cable cavity of the dielectric holder. The cable assembly has a pin contact configured to be terminated to an end of a center conductor of a cable and a tip. A center contact is received in the front cavity of the dielectric holder. The center contact has a base and a mating portion extending forward of the base. The base is positioned in the dielectric holder generally at an intersection of the front cavity and the cable cavity. The center contact has deflectable pin beams extending from the base configured to deflect outward when mated with the pin contact. The pin beams have flared lead-in tips at distal ends of the beams. The base and the pin beams are axially aligned with the cable axis to receive the pin contact.

In another embodiment, a coaxial connector assembly is provided including a housing holding an outer contact and a dielectric holder received in the outer contact. The dielectric holder has a mating segment and a cable segment orthogonal to the mating segment. The mating segment has a front cavity extending along a mating axis and the cable segment has a cable cavity extending along a cable axis. A cable assembly is received in the cable cavity of the dielectric holder. The cable assembly has a pin contact configured to be terminated to an end of a center conductor of a cable and a tip. A center contact is received in the front cavity of the dielectric holder. The center contact has a base and a mating portion extending forward of the base. The base is positioned in the dielectric holder generally at an intersection of the front cavity and the cable cavity. The center contact has deflectable pin beams extending from the base. The base and the pin beams are axially aligned with the cable axis to receive the pin contact. The pin beams are configured to deflect outward when mated with the pin contact. The base has a first thickness and the pin beams have a second thickness less than the first thickness.

In a further embodiment, a coaxial connector assembly is provided including a housing holding an outer contact and a dielectric holder received in the outer contact. The dielectric holder has a mating segment and a cable segment orthogonal to the mating segment. The mating segment has a front cavity extending along a mating axis. The cable segment has a cable cavity extending along a cable axis. The dielectric holder includes a guide opening in the cable cavity open to the front cavity. The guide opening is aligned with the cable axis. A cable assembly is received in the cable cavity of the dielectric holder. The cable assembly has a pin contact configured to be terminated to an end of a center conductor of a cable. The pin contact has a tip loaded through the guide opening. A center contact is received in the front cavity of the dielectric holder. The center contact has a base and a mating portion extending forward of the base. The base is positioned in the dielectric holder above the guide opening. The center contact has deflectable pin beams extending from the base configured to deflect outward when mated with the pin contact. The pin beams have flared lead-in tips at distal ends of the beams. The base and the pin beams are axially aligned with the guide opening to receive the pin contact. The flared lead-in tips have a larger catch area than a diameter of the guide opening.

DETAILED DESCRIPTION OF THE INVENTION

Figure 1:
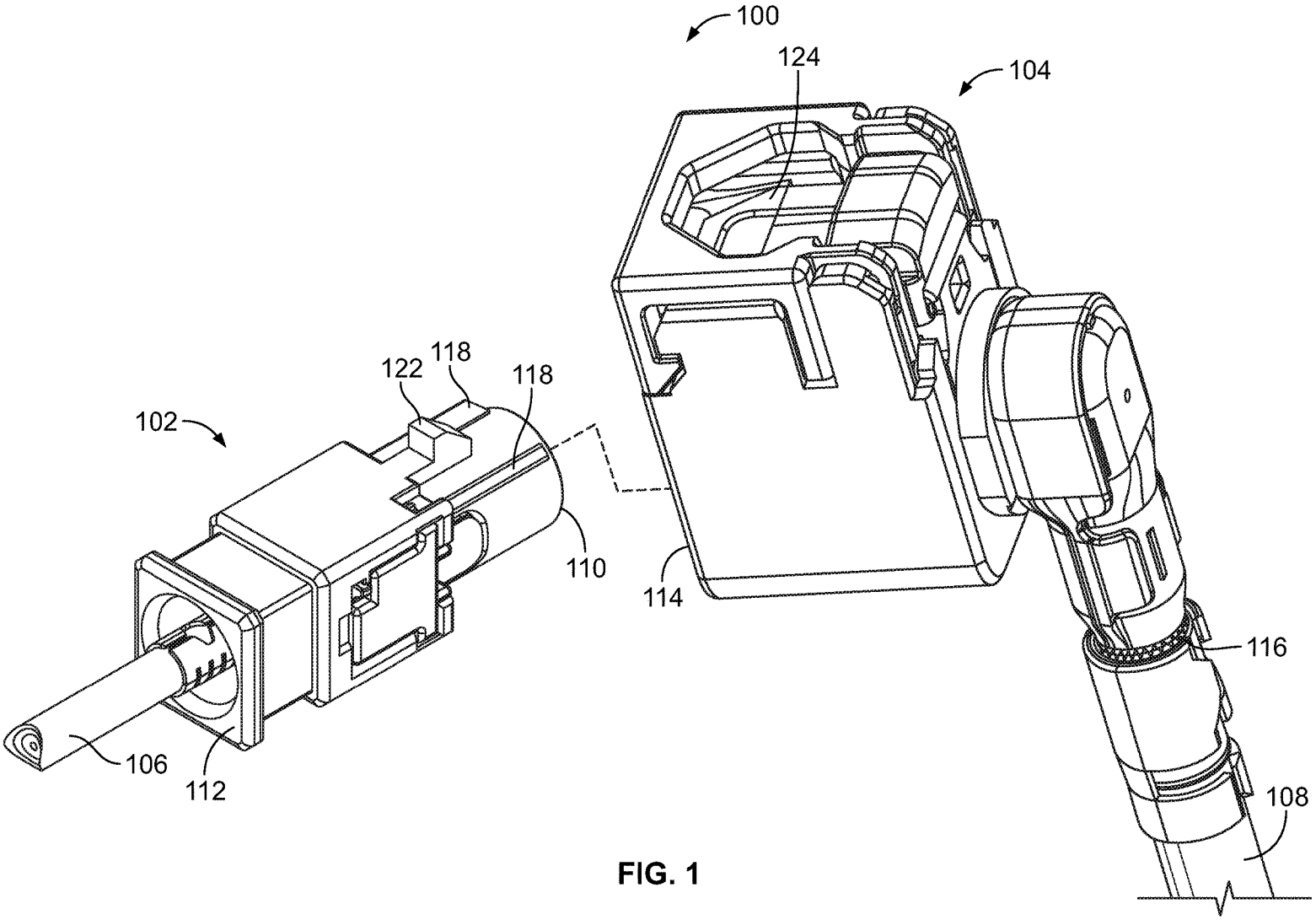
FIG. 1 illustrates a connector system having a coaxial connector assembly formed in accordance with an exemplary embodiment.

FIG. 1 illustrates a connector system 100 formed in accordance with an exemplary embodiment. The connector system 100 includes a first coaxial connector assembly 102 and a second coaxial connector assembly 104. In the illustrated embodiment, the first coaxial connector assembly 102 constitutes a jack assembly and may be referred to as a jack assembly 102. The second coaxial connector assembly 104 constitutes a plug assembly and may be referred to as a plug assembly 104. The jack assembly 102 and the plug assembly 104 are configured to be connected together to transmit electrical signals therebetween. The jack assembly 102 is terminated to a cable 106. The plug assembly 104 is terminated to a cable 108. In an exemplary embodiment, the cables 106, 108 are coaxial cables. Signals transmitted along the cables 106, 108 are transferred through the jack assembly 102 and plug assembly 104 when connected. The coaxial connector assemblies 102 and/or 104 may be terminated to a circuit board rather than a cable in alternative embodiments.

The jack assembly 102 has a mating end 110 and a terminating end or cable end 112. The jack assembly 102 is terminated to the cable 106 at the cable end 112. In an exemplary embodiment, the jack assembly 102 has a center contact, such as a pin contact that is configured for mating with a center contact of the plug assembly 104. The plug assembly 104 has a mating end 114 and a terminating end or a cable end 116. The plug assembly 104 is terminated to the cable 108 at the cable end 116. In an exemplary embodiment, the plug assembly 104 is a right angle assembly having the mating end 114 orthogonal to the cable end 116. The cable 108 extends perpendicular to the mating axis of the plug assembly 104. During mating, the mating end 110 of the jack assembly 102 is plugged into the mating end 114 of the plug assembly 104. Optionally, the jack assembly 102 may be a right angle assembly similar to the plug assembly 104.

In the illustrated embodiment, the jack assembly 102 and the plug assembly 104 constitute FAKRA connectors, which are RF connectors that have an interface that complies with the standard for a uniform connector system established by the FAKRA automobile expert group. The FAKRA connectors have a standardized keying system and locking system that fulfill the high functional and safety requirements of automotive applications. The FAKRA connectors are based on a subminiature version B connector (SMB connector) that feature snap-on coupling and are designed to operate at either 50 Ohm or 75 Ohm impedances. The connector system 100 may utilize other types of connectors other than the FAKRA connectors described herein.

The jack assembly 102 has one or more keying features 118 and the plug assembly 104 has corresponding keying features. In the illustrated embodiment, the keying features 118 are ribs and the keying features are channels that receive the ribs. Any number of keying features may be provided, and the keying features may be part of the standardized design of the FAKRA connector.

The jack assembly 102 has a latching feature 122 and the plug assembly 104 has a latching feature 124. The latching feature 122 is defined by a catch and the latching feature 124 is defined by a latch that engages the catch to hold the jack assembly 102 and the plug assembly 104 mated together.

Figure 2:
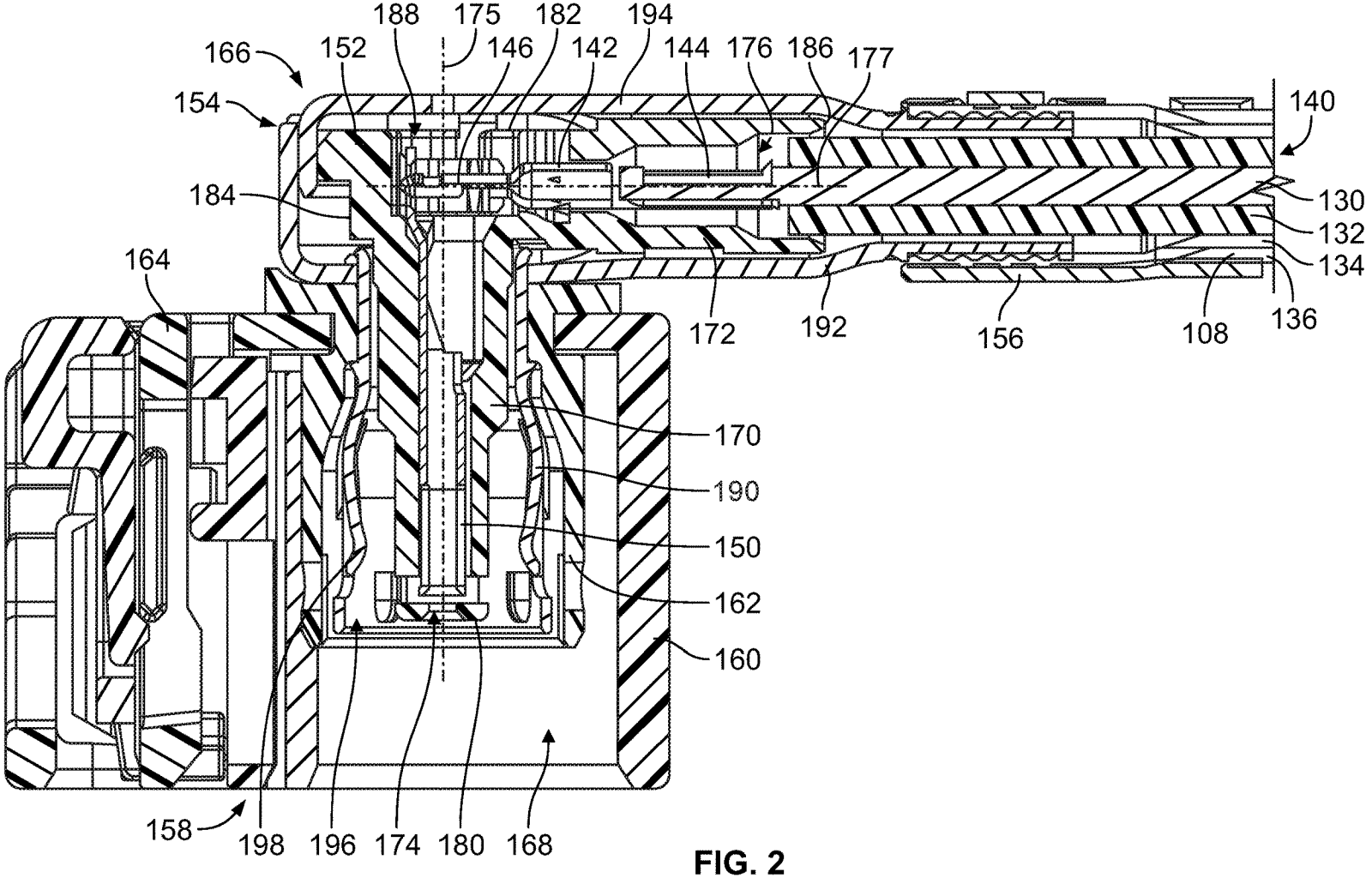
FIG. 2 is a cross-sectional view of the coaxial connector assembly.

FIG. 2 is a cross-sectional view of the plug assembly 104 and the cable 108. The cable 108 is a coaxial cable having a center conductor 130 surrounded by a dielectric 132. A cable braid 134 surrounds the dielectric 132. The cable braid 134 provides shielding for the center conductor 130 along the length of the cable 108. A cable jacket 136 surrounds the cable braid 134. The cable 108 is part of a cable assembly 140. The cable assembly 140 also includes a pin contact 142. The pin contact 142 includes a cable barrel 144 configured to be terminated to the cable 108. For example, the cable barrel 144 may be crimped or soldered to the cable 108, such as to the center conductor 130. The pin contact 142 extends to a tip 146 opposite the cable barrel 144.

The plug assembly 104 includes a center contact 150, a dielectric holder 152, an outer contact 154, an outer ferrule 156, and an outer housing 158. The center contact 150, dielectric holder 152, and outer contact 154 are configured to be received in and/or supported by the outer housing 158. The outer housing 158 is configured to be mated with the jack connector 102 (shown in FIG. 1). In the illustrated embodiment, the center contact 150 constitutes a socket contact configured to be mated with the pin contact of the jack connector 102; however other types of contacts are possible in alternative embodiments. The center contact 150 is configured to be electrically connected to the pin contact 142 to electrically connect the center contact 150 to the cable 108. For example, the pin contact 142 may be plugged in to the center contact 150.

The dielectric holder 152 receives and holds the center contact 150 and the pin contact 142. The outer contact 154 receives the dielectric holder 152 therein. The outer contact 154 surrounds the dielectric holder 152 to provide electrical shielding for at least a portion of the center contact 150, at least a portion of the pin contact 142 and/or at least a portion of the cable 108. The outer contact 154 provides shielding from electromagnetic or radio frequency interference. The dielectric holder 152 electrically isolates the center contact 150 from the outer contact 154. The outer contact 154 is configured to be electrically connected to the cable braid 134. The outer contact 154 may be a multi-piece contact formed from multiple pieces being assembled together.

The outer ferrule 156 is configured to be crimped to the cable 108 and/or the outer contact 154. The outer ferrule 156 provides strain relief for the cable 108. In an exemplary embodiment, the outer ferrule 156 is configured to be crimped to the cable braid 134 and the cable jacket 136.

The outer housing 158 surrounds at least a portion of the outer contact 154 and is axially secured with respect to the outer contact 154 to hold the outer contact 154 therein. In an exemplary embodiment, the outer housing 158 is a multi-piece housing having a front housing 160 and an insert 162. The insert 162 is received within the front housing 160 and is held therein by a lock 164. The insert 162 is used to hold the position of the outer contact 154 within the outer housing 158. In an exemplary embodiment, the insert 162 is a plastic molded part. Alternatively, the insert 162 may be a die-cast part or may be formed as part of the outer contact 154.

The center contact 150, dielectric holder 152, outer contact 154, and insert 162 define a plug subassembly 166 that is configured to be loaded into the front housing 160 as a unit. Other components may also be part of the plug subassembly 166. The front housing 160 includes a cavity 168 that receives the plug subassembly 166. The lock 164 holds plug subassembly 166 in the cavity 168. Optionally, at least a portion of the plug subassembly 166 may extend from the outer housing 158, such as rearward from the outer housing 158. In the illustrated embodiment, the outer housing 158 surrounds the front of the plug subassembly 166 for mating with the jack assembly 102.

The dielectric holder 152 has a mating segment 170 and a cable segment 172 extending from the mating segment 170. In the illustrated embodiment, the cable segment 172 is perpendicular to the mating segment 170. The mating segment 170 includes a front cavity 174 extending along a mating axis 175. The center contact 150 is received in the front cavity 174. The mating segment 170 is configured to extend into the insert 162 and the cavity 168 of the front housing 160. The cable segment 172 includes a cable cavity 176 extending along a cable axis 177. The cable axis 177 is orthogonal to the mating axis 175. The cable cavity 176 receives the cable assembly 140, such as the pin contact 142 and a portion of the cable 108. The cable cavity 176 is open to the front cavity 174 such that the pin contact 142 is able to mate with the center contact 150.

The dielectric holder 152 extends between a front 180 and a rear 182 and extends between a top 184 and a bottom 186. The mating segment 170 extends along the top 184 from the front 180 to the rear 182. The cable segment 172 extends along the rear 182 between the top 184 and the bottom 186. The front cavity 174 intersects with the cable cavity 176 at the corner near the top 184 and the rear 182. In an exemplary embodiment, the front cavity 174 includes an opening 188 at the rear 182. The center contact 150 is rear loaded into the dielectric holder 152 through the opening 188. The pin contact 142 is loaded into the cable cavity 176 through the bottom 186. The cable 108 extends from the dielectric holder 152 from the bottom 186.

The outer contact 154 may be a multi-piece contact formed from multiple pieces being assembled together. For example, in the illustrated embodiment, the outer contact 154 includes a mating contact 190, a front ground shield 192 and a rear ground shield 194 connected to the front ground shield 192. The mating contact 190 is electrically connected to the front ground shield 192. Optionally, the mating contact 190 may be integral with the front ground shield 192, such as stamped and formed from the same part. Optionally, the rear ground shield 194 may be integral with the front ground shield 192, such as stamped and formed from the same part. The mating contact 190 surrounds the center contact 150. The front ground shield 192 and the rear ground shield 194 surround the pin contact 142 and a portion of the cable 108. The front ground shield 192 and the rear ground shield 194 may be electrically connected to the cable braid 134. The outer contact 154 has a cavity 196 and a plurality of contact beams 198 at the mating end thereof. The contact beams 198 are deflectable and are configured to be spring loaded against a corresponding outer contact (not shown) of the jack assembly 102 (shown in FIG. 1). Each of the individual contact beams 198 are separately deflectable and exert a normal force on the outer contact of the jack assembly 102 to ensure engagement therewith.

Figure 4:
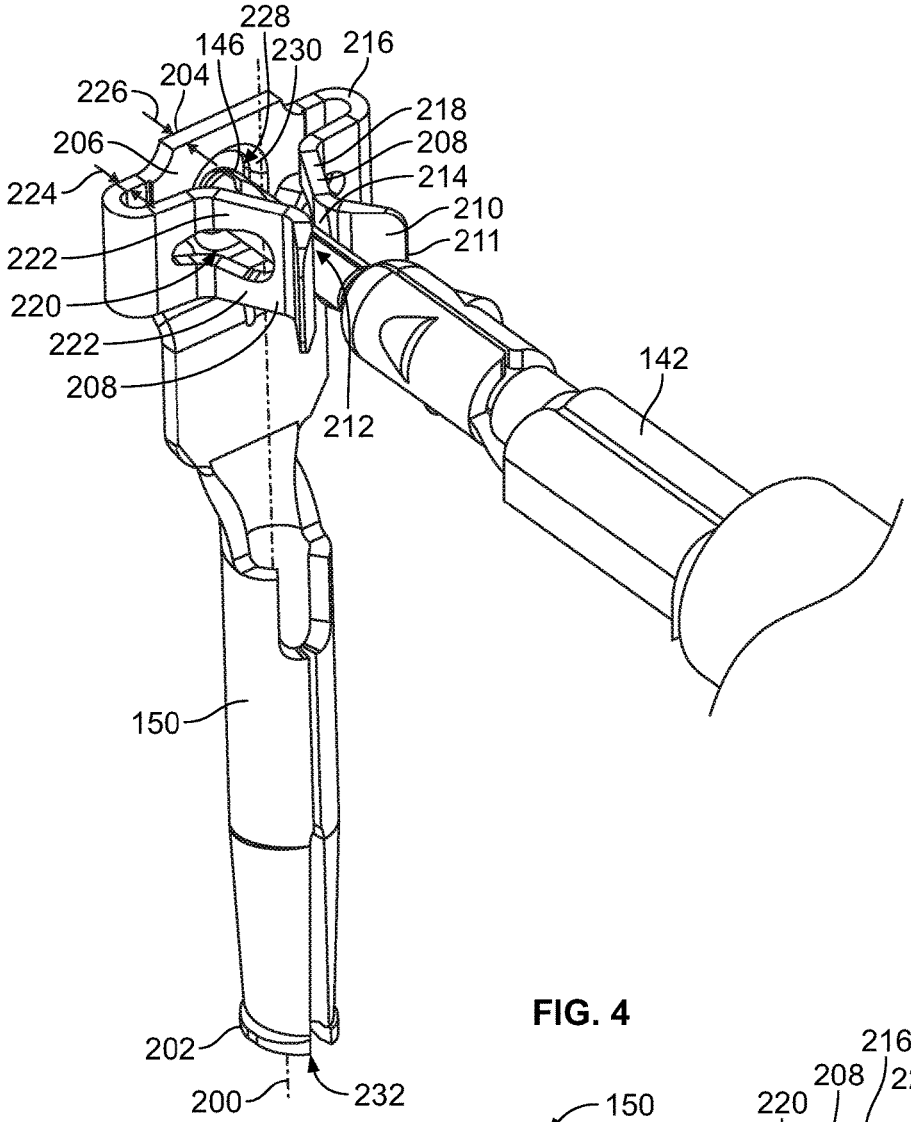
FIG. 4 illustrates a pin contact of the coaxial connector assembly mated with the center contact.
Figure 3:
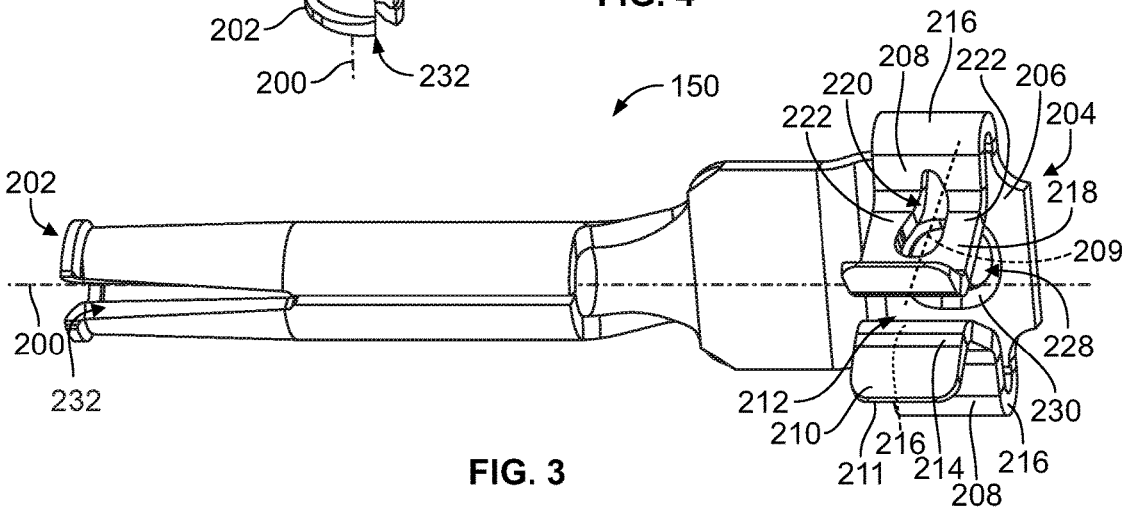
FIG. 3 is a bottom perspective view of a center contact of the coaxial connector assembly in accordance with an exemplary embodiment.

FIG. 3 is a bottom perspective view of the center contact 150 in accordance with an exemplary embodiment. FIG. 4 illustrates the pin contact 142 mated with the center contact 150. The center contact 150 extends along a longitudinal axis 200 between a mating end 202 at a front thereof and a terminating end 204 at a rear thereof. The terminating end 204 is configured to be terminated to the pin contact 142.

The center contact 150 includes a base 206 at the terminating end, such as at or near the rear of the center contact 150. Deflectable pin beams 208 extend from the base 206, such as below a bottom of the base 206. In an exemplary embodiment, the pin beams 208 extend toward the cable assembly 140 from the base 206. The pin beams 208 are configured to engage the pin contact 142 prior to the base 206 engaging the pin contact 142. The electrical signal path flows from the pin contact 142 into the pin beams 208 and then into the base 206 without creating a series current loop as compared to an inverted embodiment having a base below the pin beams. The amount of inductive electrical stubbing is thus reduced as compared to an inverted embodiment having a base below the pin beams. The impedance along the signal path at the interface between the contacts 150, 142 may more closely match the target impedance as compared to an inverted embodiment having a base below the pin beams.

The deflectable pin beams 208 have flared lead-in tips 210 at distal ends 211 thereof. The base 206 and deflectable pin beams 208 form a socket 212 at the terminating end 204 that is configured to receive the pin contact 142. The deflectable pin beams 208 extend from the base 206 to the distal ends 211 generally along pin beam axes 209. The deflectable pin beams 208 have long beam lengths to accommodate a range of deflection, such as to avoid overstressing and/or plastic deformation. The deflectable pin beams 208 maintain a normal or spring force against the pin contact 142 to ensure good electrical contact between the center contact 150 and the pin contact 142. In the illustrated embodiment, the center contact 150 includes two deflectable pin beams 208, however any number of deflectable pin beams 208 may be provided in alternative embodiments. The deflectable pin beams 208 are configured to be deflected outward when mated with the pin contact 142. For example, when the pin contact 142 is plugged into the socket 212 defined between the pin beams 208, the pin beams 208 are deflected outward and resiliently engage the pin contact 142 to create an electrical connection between the center contact 150 and the pin contact 142.

The flared lead-in tips 210 form a gathering window or funnel into the socket 212. For example, the flared lead-in tips 210 are flared outward to provide lead-in into the space between the pin beams 208. The lead-in tips 210 are flared outward away from the pin contact 142. The deflectable pin beams 208 have mating interfaces 214 above the flared lead-in tips 210. The mating interfaces 214 are configured to engage the pin contact 142 when the pin contact 142 is mated with the center contact 150. The flared lead-in tips 210 define a catch circle that is larger than the tip 146 of the pin contact 142 to ensure that the center contact 150 catches the pin contact 142 as the pin contact 142 is loaded into the socket. The flared lead-in tips 210 guide the pin contact 142 to the mating interfaces 214. The pin beams 208 have a first separation distance between the mating interfaces 214 and a second separation distance between the distal ends 211 that is greater than the first separation distance. The funnel shaped terminating end 204 accommodates for mis-alignment of the pin contact 142 and reduces stubbing during mating of the pin contact 142 with the center contact 150.

The pin beams 208 include folded portions 216 extending from the base 206, such as from both sides of the base 206. The folded portions 216 accommodate deflection of the pin beams 208. The folded portions 216 may be bent back over the base 206 such that portions thereof are parallel to the base 206. The pin beams 208 include extensions 218 extending from the folded portions 216 to the mating interfaces 214. The extensions 218 are bent or angled relative to the folded portions 216. The extensions 218 extend generally away from the base 206. The folded portions 216 and the extensions 218 increase the overall beam length of the pin beams 208.

In an exemplary embodiment, the pin beams 208 include slots 220 surrounded on both sides by beam arms 222. The pin beams 208 are flexed at the beam arms 222. The beam arms 222 may transition between the folded portions 216 and the extensions 218. The beam arms 222 may include bends or curves at the transition between the folded portions 216 and the extensions 218. The pin beams 208 are deflectable at the beam arms 222. The slots 220 make the pin beams 208 more flexible. The beam arms 222 distribute stresses in the pin beams 208 through the radiused area at the transition between the folded portions 216 and the extensions 218.

In an exemplary embodiment, the pin beams 208 have a thickness 224 that is thinner than a thickness 226 of the base 206. For example, the pin beams 208 may be coined making the material of the pin beams 208 thinner than the base 206. Having the pin beams 208 thinner allows the pin beams 208 to be more flexible, while the rest of the center contact 150 is thicker and thus more robust, such as for mating with the mating contact of the mating connector.

The base 206 includes an opening 228 configured to receive the tip 146 of the pin contact 142. The opening 228 is aligned with the cable axis 177. The opening 228 may have a diameter that is slightly larger than the tip 146 of the pin contact 142 to accommodate offset or misalignment of the pin contact 142 during assembly. The opening 228 defines a catch radius configured to catch the tip 146 of the pin contact 142 and center the pin contact 142 relative to the base 206. The opening 228 may have a lead-in to guide the pin contact 142 into the opening 228. The lead-in to the opening 228 defines a strain relief surface 230 for the pin beams 208 of the center contact 150. As such, the opening 228 provides overstress protection for the pin beams 208. For example, the strain relief surface 230 forces the pin contact 142 to a generally centered positioned between the pin beams 208, not allowing the pin contact 142 to shift in one direction or the other, which can cause overstress and/or plastic deformation of the pin beam 208 in such offset direction. The opening 228 receives the pin contact 142 to allow the pin contact 142 to pass through the base 206. As such, the opening 228 accommodate a large amount of contact wipe of the pin contacts 142 along the pin beams 208. For example, the pin contact 142 does not bottom out against the base 206, but rather passes through the base 206 during assembly. As such, the pin beams 208 may be made shorter and/or remain closer to the base 206 reducing the overall height of the center contact 150.

The mating end 202 of the center contact 150 extends forward of the base 206. In the illustrated embodiment, the mating end 202 defines a socket 232 configured to receive the pin contact of the jack assembly 102. The mating end 202 may be formed by wrapping the ends of the center contact 150 to form the socket 232. In an exemplary embodiment, the center contact 150 is a stamped and formed contact, which may be manufactured rather inexpensively.

Figure 5:
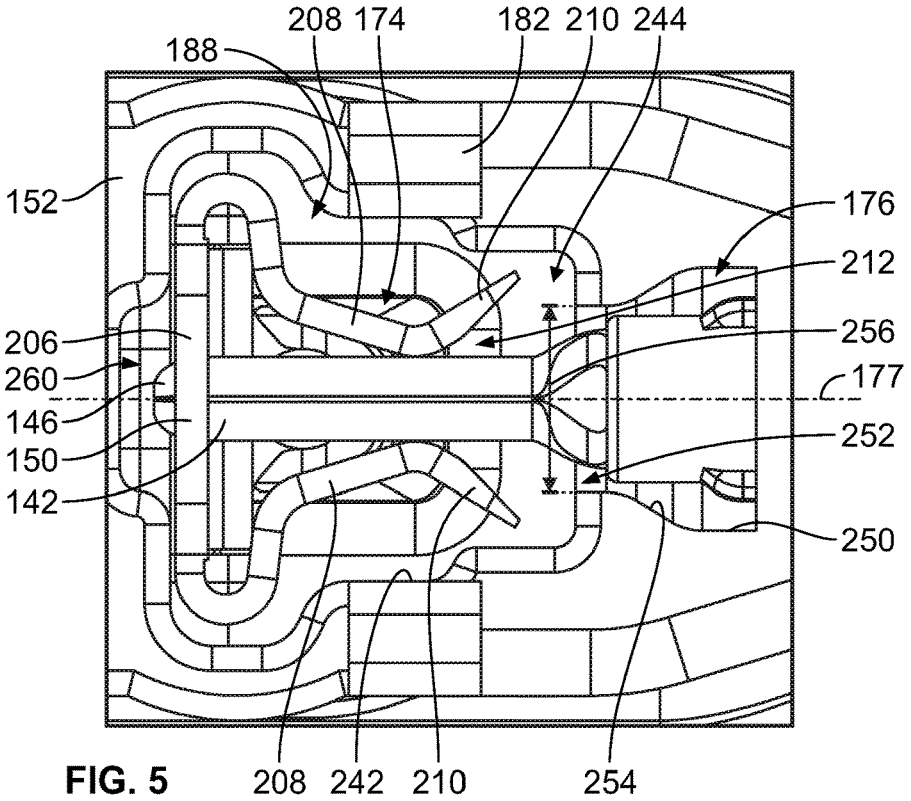
FIG. 5 is a rear perspective view of a portion of a dielectric holder of the coaxial connector assembly formed in accordance with an exemplary embodiment.
Figure 6:
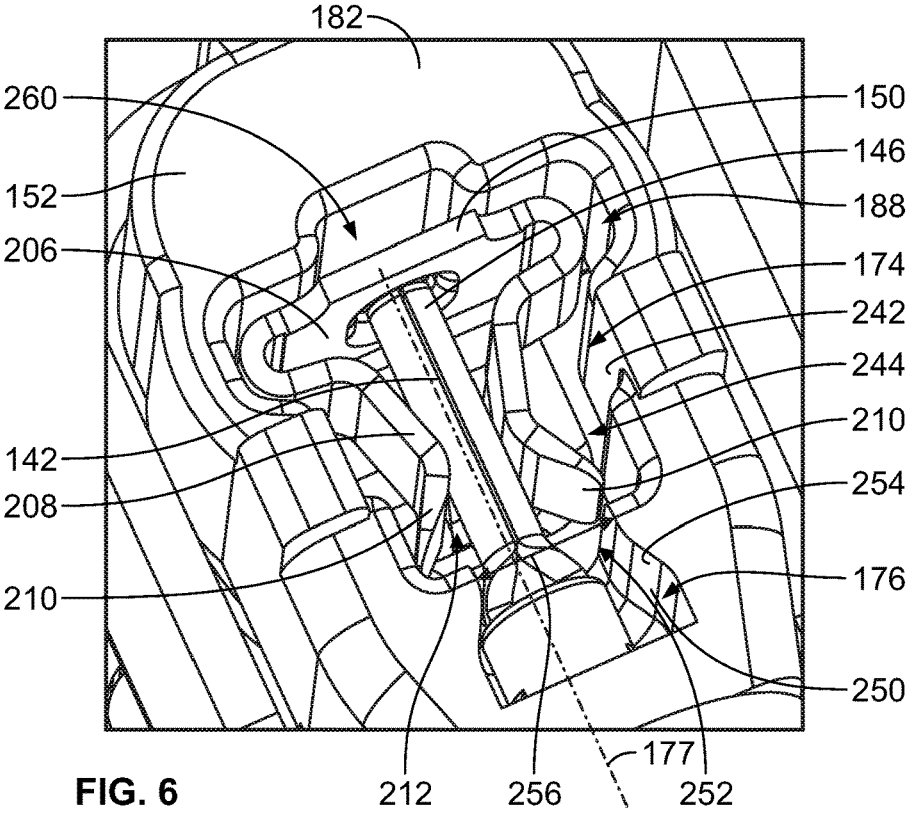
FIG. 6 is a rear perspective view of a portion of the dielectric holder.

FIG. 5 is a rear perspective view of a portion of the dielectric holder 152 formed in accordance with an exemplary embodiment. FIG. 6 is a rear perspective view of a portion of the dielectric holder 152 formed in accordance with an exemplary embodiment. The dielectric holder 152 includes the opening 188 at the rear 182 that is open to the front cavity 174. The front cavity 174 is defined by a cavity wall 242 along an interior of the dielectric holder 152. The front cavity 174 is sized and shaped to receive the center contact 150.

In an exemplary embodiment, the dielectric holder 152 includes an expansion slot 244 formed in the cavity wall 242, such as below the front cavity 174. The expansion slot 244 may extend into the cable cavity 176. The expansion slot 244 defines a space or area that is sized and shaped to receive the flared lead-in tips 210 of the center contact 150. The expansion slot 244 forms part of the front cavity 174. The expansion slot 244 is an enlarged area around the center contact 150. The expansion slot 244 widens or increases the size of the front cavity 174 to receive the flared lead-in tips 210 when the flared lead-in tips 210 are deflected outward during mating with the pin contact 142. Optionally, the walls defining the expansion slot 244 (e.g., outside of the flared lead-in tips 210) may provide overstress protection for the pin beams 208. For example, the walls may limit deflection of the pin beams 208 to one side or the other, which may force the pin contact 142 to a generally centered positioned between the pin beams 208, not allowing the pin contact 142 to shift in one direction or the other, which can cause overstress and/or plastic deformation of the pin beam 208 in such offset direction. Optionally, the expansion slot 244 may be open at the rear 182.

In an exemplary embodiment, the dielectric holder 152 includes a guide wall 250 in the cable cavity 176. The guide wall 250 is positioned below the expansion slot 244. The guide wall 250 may be provided at or near the top of the cable cavity 176. The guide wall 250 includes a guide opening 252, which may open to the front cavity 174 and the center contact 150. The pin contact 142 is loaded into the front cavity 174 through the guide opening 252. In an exemplary embodiment, the guide opening 252 includes chamfered lead-in surfaces 254 that guide the pin contact 142 into the center contact 150. The guide opening 252 may be aligned with the socket 212 of the center contact 150 to direct the pin contact 142 into a mated position with the center contact 150. The guide opening 252 may be aligned with the cable axis 177. Optionally, the guide opening 252 may have a smaller diameter 256 than the expansion slot 244. The guide opening 252 may have a smaller diameter than a catch area of the flared lead-in tips 210 to align the pin contact 142 with the socket 212 and to reduce stubbing. As such, the guide opening 252 directs the pin contact 142 into the socket 212 without stubbing on the pin beams 208. The lead-in tips 210 may further direct the pin contact 142 into the socket 212.

The dielectric holder 152 includes a pocket 260 formed in the cavity wall 242, such as above the base 206. The pocket 260 may be open to the front cavity 174. The pocket 260 defines a space or area that is sized and shaped to receive the tip 146 of the pin contact 142 when the pin contact 142 is plugged into the center contact 150. The pocket 260 is aligned with the cable axis 177.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A coaxial connector assembly comprising:

a housing holding an outer contact;

a dielectric holder received in the outer contact, the dielectric holder having a mating segment and a cable segment orthogonal to the mating segment, the mating segment having a front cavity extending along a mating axis, the cable segment having a cable cavity extending along a cable axis;

a cable assembly received in the cable cavity of the dielectric holder, the cable assembly having a pin contact configured to be terminated to an end of a center conductor of a cable, the pin contact having a tip, the pin contact extending longitudinally along a pin axis parallel to the cable axis; and a center contact received in the front cavity of the dielectric holder, the center contact having a base and a mating portion extending forward of the base, the base positioned in the dielectric holder generally at an intersection of the front cavity and the cable cavity along a top of the front cavity and directly vertically above the cable cavity, the center contact having deflectable pin beams extending along pin beam axes downward from the base along opposite sides of the cable cavity to distal ends opposite the base, the pin beams configured to deflect outward when mated with the pin contact along the pin beam axes, the pin beams having flared lead-in tips at the distal ends of the pin beams receiving the pin contact when the center contact is mated with the pin contact, the base being axially aligned with the cable axis to receive the pin contact between the pin beams in a pin mating direction parallel to the pin axis, the pin beam axes being generally parallel with the cable axis, the pin beams including spaced apart beam arms with slots positioned between corresponding beam arms, the beam arms located on both sides of the slots, the beam arms extending parallel to the pin axis and the pin mating direction between the distal ends and the base, the slots being elongated parallel to the beam arms along the cable axis, the pin beams being flexed at the beam arms;

wherein the pin beams extend toward the cable assembly from the base on opposite sides of the pin axis, each pin beam having a first curve being curved inward toward the pin axis from the base and each pin beam having a second curve being curved outward at the lead-in tips such that the pin beams have an S-shaped configuration.

2. The coaxial connector assembly of claim 1, wherein the first curve of each pin beam has a smaller radius of curvature compared to a radius of curvature of the second curve of the corresponding pin beam.

3. The coaxial connector assembly of claim 1, wherein the pin beams include separable mating interfaces configured to engage and electrically connect to the pin contact.

4. The coaxial connector assembly of claim 1, wherein the lead-in tips are flared outward away from the pin contact.

5. The coaxial connector assembly of claim 1, wherein the pin beams include mating segments, the lead-in tips being flared outward from the mating segments such that the pin beams have a first separation distance between the mating segments and a second separation distance between the distal ends greater than the first separation distance.

6. The coaxial connector assembly of claim 1, wherein the base has a first thickness, the pin beams having a second thickness less than the first thickness.

7. The coaxial connector assembly of claim 1, wherein the base has an opening axially aligned with the cable axis, the opening receiving the tip of the pin contact.

8. The coaxial connector assembly of claim 7, wherein the opening is bounded by a strain relief surface, the strain relief surface configured to engage and locate the pin contact to prevent overstress of the pin beams.

9. The coaxial connector assembly of claim 1, wherein the dielectric holder includes an expansion slot that receives the base and the pin beams of the center contact, the pin beams being deflectable into the expansion slot, the dielectric holder including a guide opening in the cable cavity open to the expansion slot, the guide opening receiving the pin contact and guiding the pin contact into mating with the pin beams.

10. The coaxial connector assembly of claim 9, wherein the lead-in tips having a wider catch area than the guide opening to receive the pin contact.

11. The coaxial connector assembly of claim 1, wherein the dielectric holder includes a pocket above the base, the pocket receiving the tip of the pin contact when the pin contact is plugged into the center contact.

12. The coaxial connector assembly of claim 1, wherein the front cavity is open at a rear of the dielectric holder to receive the center contact through the rear of the dielectric holder.

13. The coaxial connector assembly of claim 1, wherein the dielectric holder includes a guide opening in the cable cavity open to the front cavity, the guide opening being aligned with the cable axis, the guide opening having a first width, the tip of the pin contact being loaded through the guide opening, the tip having a tip width less than the first width such that the tip has a limited amount of movement in the guide opening, the base of the center contact being positioned in the dielectric holder above the guide opening, the pin beams of the center contact having mating interfaces and the pin beams having flared lead-in tips beyond the mating interfaces at the distal ends of the pin beams being deflectable relative to each other for mating with the pin contact, the base and the pin beams being axially aligned with the guide opening to receive the pin contact, the mating interfaces being separated by a second width less than the first width, the flared lead-in tips being separated by a third width greater than the first width such that the flared lead in tips have a larger catch area than the first width of the guide opening.

14. The coaxial connector assembly of claim 1, wherein each pin beam includes a folded portion extending from the base, the folded portion being bent over the base and extending parallel to the base, the pin beam including an extension extending from the folded portion to the distal ends, the extension being bent at a non-parallel angle relative to the folded portion to extend away from the base.

15. The coaxial connector assembly of claim 1, wherein the pin beams are bent at a transition portion of the beam arms between a first portion and a second portion of each beam arm, the first portion of each beam arm being angled non-parallel to the second portion of the corresponding beam arm, the slot extending along the first portion and the second portion of the beam arm such that the slot spans the transition portion.

16. A coaxial connector assembly comprising:

a housing holding an outer contact;

a dielectric holder received in the outer contact, the dielectric holder having a mating segment and a cable segment orthogonal to the mating segment, the mating segment having a front cavity extending along a mating axis, the cable segment having a cable cavity extending along a cable axis;

a cable assembly received in the cable cavity of the dielectric holder, the cable assembly having a pin contact configured to be terminated to an end of a center conductor of a cable, the pin contact having a tip; and a center contact received in the front cavity of the dielectric holder, the center contact having a base and a mating portion extending forward of the base, the base positioned in the dielectric holder generally at an intersection of the front cavity and the cable cavity, the center contact having deflectable pin beams extending from the base, the base and the pin beams being axially aligned with the cable axis to receive the pin contact, the pin beams being configured to deflect outward when mated with the pin contact, the base being a metal structure having a first thickness as the smallest measure defined between an inner surface and an outer surface of the base being measured normal to the outer surface, the pin beams being metal structures each having a second thickness as the smallest measure defined between an inner surface and an outer surface of the corresponding pin beam being measured normal to the outer surface, the metal structures of the pin beams being thinner than the metal structure of the base such that the second thickness is less than the first thickness, wherein the inner surface of each pin beam defines a mating interface engaging the pin contact;

wherein the pin beams extend toward the cable assembly from the base on opposite sides of the pin contact, each pin beam having a first curve being curved inward toward the pin contact from the base and each pin beam having a second curve being curved outward at the lead-in tips such that the pin beams have an S-shaped configuration.

17. The coaxial connector assembly of claim 16, wherein the pin beams include slots with beam arms on both sides of the slots, the beam arms and the slot transitioning through a bend in the pin beams, the pin beams being flexed at the beam arms.

18. The coaxial connector assembly of claim 16, wherein the base has an opening axially aligned with the cable axis, the opening receiving the tip of the pin contact, the opening being bounded by a strain relief surface, the strain relief surface configured to engage and locate the pin contact to prevent overstress of the pin beams.

19. The coaxial connector assembly of claim 16, wherein the dielectric holder includes an expansion slot that receives the base and the pin beams of the center contact, the pin beams being deflectable into the expansion slot, the dielectric holder including a guide opening in the cable cavity open to the expansion slot, the guide opening receiving the pin contact and guiding the pin contact into mating with the pin beams.

20. The coaxial connector assembly of claim 16, wherein the dielectric holder includes a guide opening in the cable cavity open to the front cavity, the guide opening being aligned with the cable axis, the guide opening having a first width, the tip of the pin contact being loaded through the guide opening, the tip having a tip width less than the first width such that the tip has a limited amount of movement in the guide opening, the base of the center contact being positioned in the dielectric holder above the guide opening, the pin beams of the center contact having mating interfaces and the pin beams having flared lead-in tips beyond the mating interfaces at the distal ends of the pin beams being deflectable relative to each other for mating with the pin contact, the base and the pin beams being axially aligned with the guide opening to receive the pin contact, the mating interfaces being separated by a second width less than the first width, the flared lead-in tips being separated by a third width greater than the first width such that the flared lead in tips have a larger catch area than the first width of the guide opening.

21. A coaxial connector assembly comprising:

a housing holding an outer contact;

a dielectric holder received in the outer contact, the dielectric holder having a mating segment and a cable segment orthogonal to the mating segment, the mating segment having a front cavity extending along a mating axis, the cable segment having a cable cavity extending along a cable axis;

a cable assembly received in the cable cavity of the dielectric holder, the cable assembly having a pin contact configured to be terminated to an end of a center conductor of a cable, the pin contact having a tip; and a center contact received in the front cavity of the dielectric holder, the center contact having a base and a mating portion extending forward of the base, the base positioned in the dielectric holder generally at an intersection of the front cavity and the cable cavity, the center contact having deflectable pin beams extending from the base configured to deflect outward when mated with the pin contact, the pin beams having flared lead-in tips at distal ends of the beams, the base and the pin beams being axially aligned with the cable axis to receive the pin contact, wherein the pin beams extend toward the cable assembly from the base on opposite sides of the pin contact, each pin beam having a first curve being curved inward toward the pin axis from the base and each pin beam having a second curve being curved outward at the lead-in tips such that each pin beam has an S-shaped configuration.

22. The coaxial connector assembly of claim 21, wherein each pin beam includes a slot with beam arms on both sides of the slot, the beam arms and the slot transitioning through a bend in the pin beam.

* * * * *